US006237862B1

(12) United States Patent
Kah, III et al.

(10) Patent No.: US 6,237,862 B1
(45) Date of Patent: May 29, 2001

(54) ROTARY DRIVEN SPRINKLER WITH MULITIPLE NOZZLE RING

(76) Inventors: Carl L. C. Kah, III, 778 Lakeside Dr., N. Palm Beach; Carl L. C. Kah, Jr., 58 Uno Lago, Juno Beach, both of FL (US) 33408

( * ) Notice: Subject to any disclaimer, the term of this patent is extended or adjusted under 35 U.S.C. 154(b) by 0 days.

(21) Appl. No.: 09/209,739

(22) Filed: Dec. 11, 1998

(51) Int. Cl.[7] ..... B05B 1/14

(52) U.S. Cl. ..... 239/391; 239/392; 239/393; 239/394; 239/548; 239/566

(58) Field of Search ..... 239/390, 391, 239/392, 393, 394, 548, 561, 566

(56) References Cited

U.S. PATENT DOCUMENTS

| | | | | |
|---|---|---|---|---|
| D. 388,502 | | 12/1997 | Kah, III | D23/241 |
| 3,083,872 | | 4/1963 | Meshberg | 222/42 |
| 3,094,283 | | 6/1963 | Balister | 239/393 |
| 3,526,363 | | 9/1970 | Hauser | 239/206 |
| 3,645,451 | | 2/1972 | Hauser | 239/206 |
| 3,762,650 | | 10/1973 | Radecki | 239/396 |
| 4,471,908 | * | 9/1984 | Hunter | 239/11 |
| 4,624,412 | | 11/1986 | Hunter | 239/232 |
| 4,625,914 | | 12/1986 | Sexton et al. | 239/206 |
| 4,717,074 | | 1/1988 | Karliner et al. | 239/288 |
| 4,784,325 | | 11/1988 | Walker et al. | 239/204 |
| 4,867,378 | | 9/1989 | Kah, Jr. | 239/206 |
| 4,901,924 | | 2/1990 | Kah, Jr. | 239/242 |
| 5,098,021 | | 3/1992 | Kah, Jr. | 239/242 |
| 5,104,045 | | 4/1992 | Kah, Jr. | 239/246 |
| 5,226,599 | | 7/1993 | Lindermeir et al. | 239/205 |
| 5,417,370 | | 5/1995 | Kah, Jr. | 239/242 |
| 5,526,982 | | 6/1996 | McKenzie | 239/240 |
| 5,653,390 | | 8/1997 | Kah, Jr. | 239/242 |
| 5,746,374 | * | 5/1998 | Simonetti et al. | 239/391 X |
| 5,765,757 | | 6/1998 | Bendall | 239/205 |
| 5,826,797 | | 10/1998 | Kah, III | 239/394 |
| 5,868,316 | * | 2/1999 | Scott | 239/73 |

FOREIGN PATENT DOCUMENTS

| | | | |
|---|---|---|---|
| 2313132 | 12/1976 | (FR) | 239/394 |
| 975101 | 11/1982 | (SU) | 239/390 |

* cited by examiner

*Primary Examiner*—David A. Scherbel
*Assistant Examiner*—Robin O. Evans
(74) *Attorney, Agent, or Firm*—Ostrolenk, Faber, Gerb & Soffen, LLP

(57) ABSTRACT

A rotary drive sprinkler having a multiplicity of nozzles which can be changed at any time. The nozzle assembly can have a cylindrical housing having a plurality of nozzles to rotate against a cylindrical housing having at least one stream outlet opening. A nozzle assembly can have a cylindrical cavity at its outer portion receiving a flexible nozzle strip for directing flow from a nozzle housing. A nozzle sleeve, or ring, having a plurality of exit nozzles around the outside of the nozzle assembly can be rotated about an inner housing.

16 Claims, 15 Drawing Sheets

ROTARY DRIVEN SPRINKLER WITH MULITIPLE NOZZLE RING

TECHNICAL FIELD

This invention relates to rotary drive sprinklers with a ring, or sleeve, having multiple nozzles therearound as part of a nozzle housing assembly, said ring of nozzles being rotatable to be rotated to have a selected nozzle placed into operation.

BACKGROUND ART

U.S. Pat. No. 5,826,797 to Carl L. C. Kah, III for OPERATIONALLY CHANGEABLE MULTIPLE NOZZLES SPRINKLER is included here as if fully set forth and provides for change from one nozzle to another by rotationally moving a nozzle selection sleeve into the flow path of a nozzle housing passage.

U.S. patent application Ser. No. 09/104,456 to Carl L. C. Kah, Jr. and Carl L. C. Kah, III for SELECTABLE NOZZLE ROTARY DRIVEN SPRINKLER is included here as if fully set forth and provides for change from one nozzle to another by rotating an internal selection rotor.

U.S. patent application Ser. No. 09/128,130 to Carl L. C. Kah, Jr. and Carl L. C. Kah, III for ROTARY NOZZLE ASSEMBLY HAVING INSERTABLE ROTATABLE NOZZLE DISC is included here as if fully set forth and provides for change from one nozzle to another by having an insertable rotatable nozzle disc.

Other patents setting forth a background for this invention are: U.S. Pat. Nos. 3,094,283; 5,226,599; 5,526,982; 5,765,757; U.S. Des. Pat. No. 388,502; Russian Patent No. 975,101; and French Patent No. 2,313,132.

DISCLOSURE OF INVENTION

It is an object of this invention to have a nozzle ring, or sleeve, as part of a nozzle housing assembly, said nozzle ring, or sleeve, having multiple nozzles to provide a desired sprinkler stream.

It is another object of this invention to provide an internal gear around the upper inside of the cylindrical nozzle ring for rotating the nozzle ring with respect to the nozzle housing assembly. A small drive gear mounted in the nozzle housing assembly engages said internal gear and is turned from the top of the nozzle housing assembly to rotate the nozzle ring.

A further object of the invention is to have a cooperating mechanism between the cylindrical nozzle housing and cylindrical nozzle ring for holding a selected nozzle in place during sprinkler operation.

It is another object of this invention to have a settable "OFF" position where one of the multiple nozzle positions is omitted and a nozzle ring made solid.

It is a further object of this invention to provide a flexible strip of nozzles as part of the nozzle ring, or sleeve, to rotate therewith.

A further object of this invention is to provide individual nozzle identification and an arrowhead, or other direction-pointing device, on a nozzle housing assembly cover which points at the individual nozzle which is in operating position.

Another object of this invention is to provide a nozzle ring, sleeve, or strip of nozzles which can be formed into a ring and where each individual nozzle on the nozzle strip or ring can be moved by turning a nozzle selection shaft on the nozzle housing top into a selected nozzle flowing position to provide a desired nozzle stream exiting from the nozzle housing assembly.

A further object of this invention is to provide a stationary circumferential spaced group of nozzles in the nozzle housing flow path and provide an exit opening in a rotationally mounted cylindrical sleeve around the outside of the nozzle housing assembly for selecting the desired nozzle.

A still further alternate configuration is to have multiple nozzles mounted in the flow path of the sprinkler's nozzle housing assembly which can be alternately rotated to place a selected nozzle in position for flow out the nozzle housing stream exit opening.

An important feature is the concept of being able to mold the nozzle internal features, front and back side, into a flexible piece that can then be rolled up to provide a relatively large number of nozzles around the circumference of a nozzle housing assembly with longer length nozzle passages.

BEST MODE FOR CARRYING OUT THE INVENTION

Figure 1:
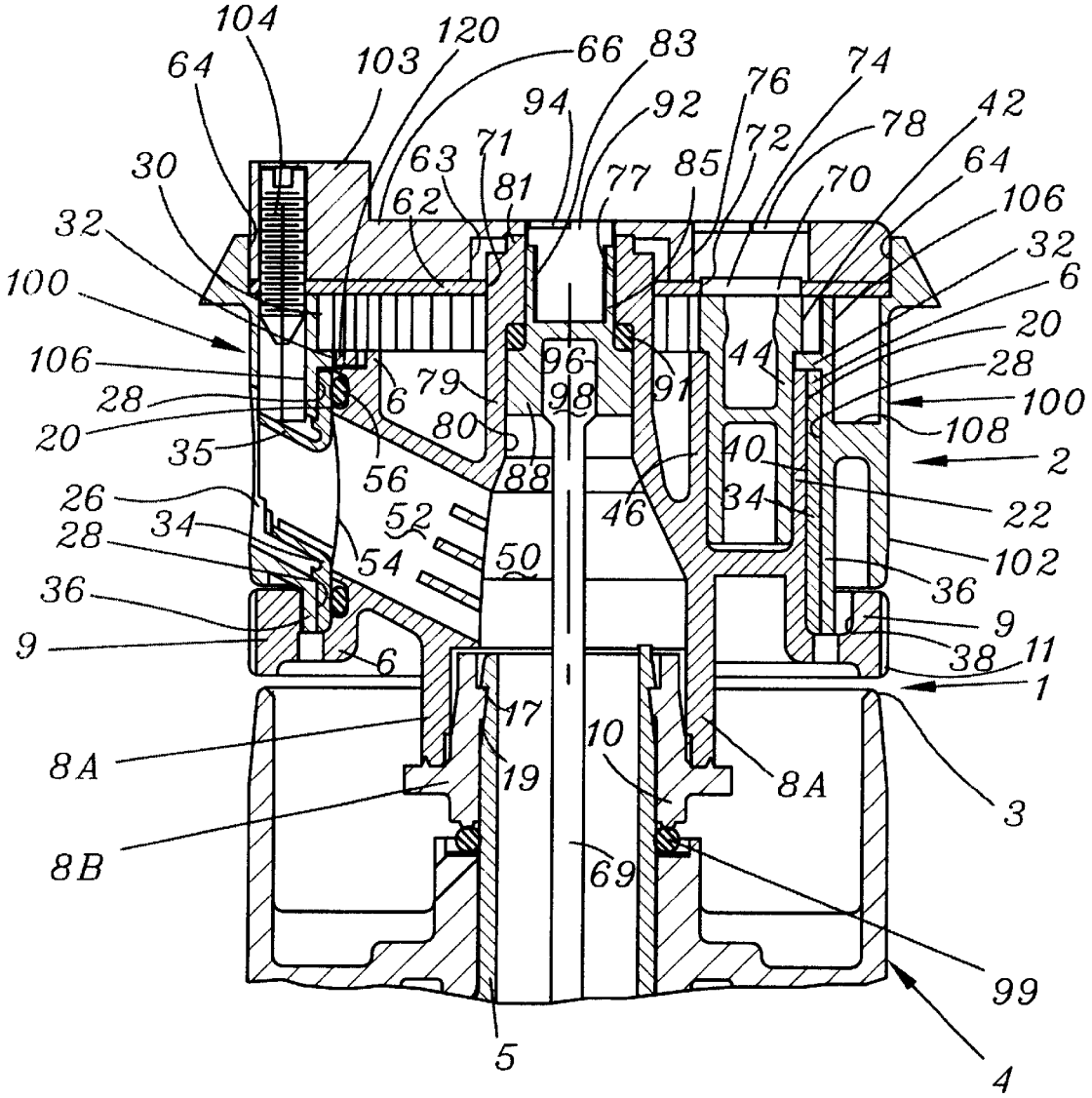
FIG. 1 is a side view in section of the upper part of a rotary drive sprinkler having a cylindrical nozzle housing assembly with a nozzle ring taken along the line 1—1 of FIG. 2 having a plurality of nozzles around the outside of a nozzle housing assembly; to provide a clear showing of the top of the arc set mechanism the key recess is shown in line with 180°.
Figure 2:
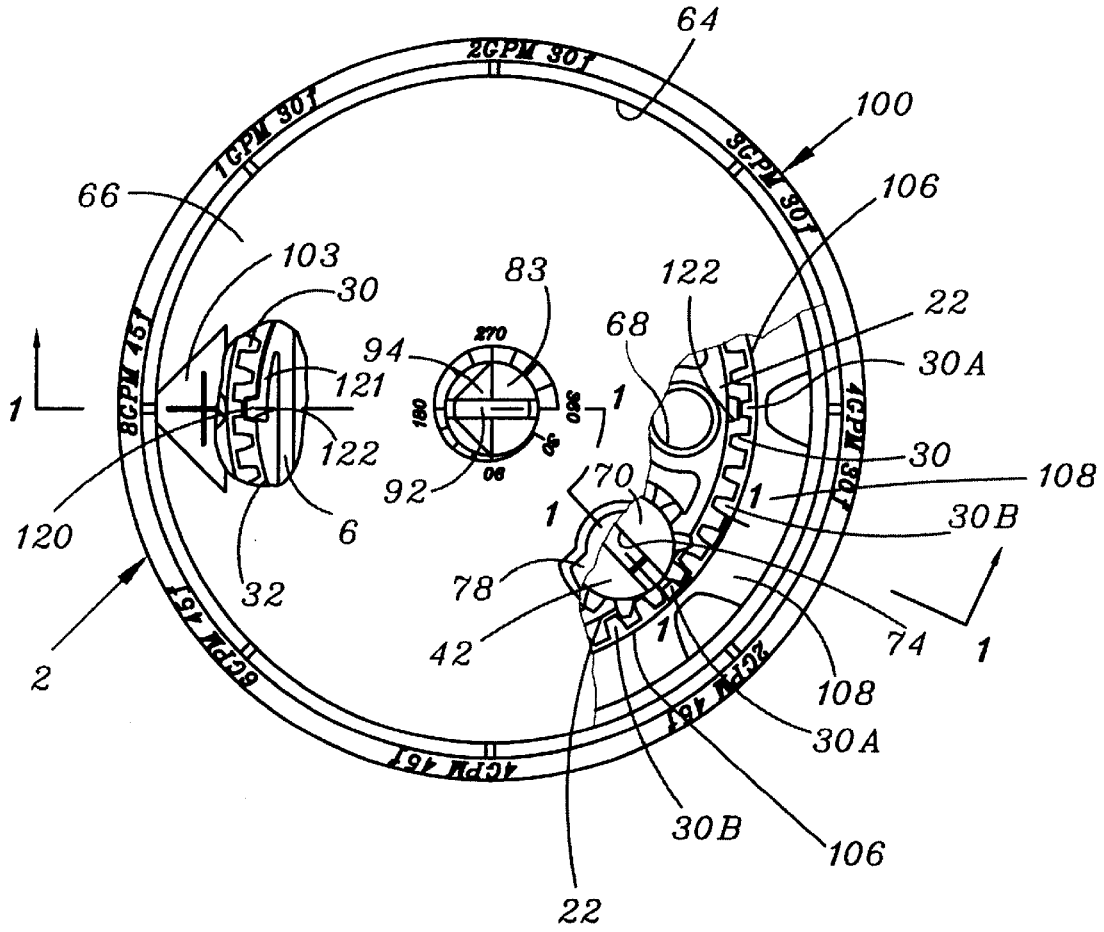
FIG. 2 is a top view of the rotary drive sprinkler housing of FIG. 1 showing the detent mechanism for aligning a nozzle with a water flow passage; the nozzle ring rotation positioning drive gear is also shown as well as the nozzle characteristic indications on the top of the nozzle housing.

Referring to FIG. 1 and FIG. 2 of the drawings, an upper portion of a rotatable sprinkler 1 is shown having a cylindrical nozzle housing assembly 2 mounted for rotation on top of a riser assembly 4. The riser assembly 4 has an opening 3 at its upper end for a nozzle housing assembly hollow output drive shaft 5 to exit the riser assembly 4 and be connected to nozzle housing assembly 2. An arc set indicating and setting mechanism is included to set the cylindrical nozzle housing assembly 2 at a specific arc of oscillation.

The cylindrical nozzle housing assembly 2 has an inner housing structure 6 which has an outwardly facing cylindrical surface 20 on a cylindrical wall 22. The cylindrical wall 22 has an outwardly extending flange 9 at its bottom which extends to match the diameter of the riser assembly 4. The center of the inner housing structure 6 has bottom portions 8A and 8B which extend into the opening 3 at the upper end of the riser assembly 4 and bottom portion 8B has an opening member 10 extending upwardly therefrom to receive the drive shaft 5 extending from the riser assembly 4. The drive shaft 5 is fixed in the opening member 10 in a manner to be hereinafter described. The bottom portion 8B extends outwardly to connect to bottom portion 8A to close off the bottom of cylindrical nozzle housing assembly 2.

Bottom portion 8A is fixed to bottom portion 8B by sonic welding. Other known means can be used to fix these parts together. Drive shaft 5 is fixed in the opening member 10 by a snap fit at 17 and rotationally locked against rotation by a splined connection 19 therebetween. An "O"-ring seal 99 is located between the output drive shaft 5 and part of the riser assembly 4 as a dirt seal.

A nozzle ring, or sleeve, 100 is positioned around the cylindrical surface 20 for rotation. The nozzle ring 100 has a cylindrical outer surface 102 forming the outer surface of the nozzle housing assembly 2 along with flange 9. Surface 102 has nozzle outlet openings 26 spaced therearound. The outer surface 102 extends outwardly to match the outer circumference of the outwardly extending flange 9.

The nozzle ring 100 has a cylindrical inner surface 28 with an integral internal gear 30 having teeth 30B formed at the top with a short flat inwardly extending flange 32 positioned below the internal gear 30. The inner surface 28 extends from the flange 32 to the bottom of an annular groove 38 in flange 9. A flexible nozzle strip 34 is placed around and against cylindrical inner surface 28 from the short flat inwardly extending flange 32 to the bottom of the inner surface 28 in annular groove 38. The flexible nozzle strip 34 has a nozzle 35 projecting outwardly therefrom for each nozzle outlet opening 26. The lower ends of the flexible nozzle strip 34 and lower extending cylindrical flange 36 of nozzle ring, or sleeve, 100 extend into the annular groove 38 in the outwardly extending flange 9 to permit the nozzle ring 100 and flexible nozzle strip 34 to rotate with respect to the inner housing structure 6. The outer surface of the flange 9 can have a roughened, or knurled, surface 11 to hold the inner housing structure 6 in place when the nozzle ring 100 is being turned, if desired.

The inner surface 40 of the flexible nozzle strip 34 is rotated against the cylindrical surface 20 by movement of the internal gear 30 by a meshing nozzle positioning drive gear 42 extending through an opening in the cylindrical wall 22. The drive gear 42 is mounted on a shaft 44 positioned for rotation in a cylindrical bearing member 46 of inner housing structure 6.

A center flow chamber 50 is located above the opening member 10 to receive flow from the hollow drive shaft 5. A flow directing passage 52, angled upwardly, connects the center flow chamber 50 through the cylindrical wall 22 to the outwardly facing cylindrical surface 20 below the internal gear 30. The flexible nozzle strip 34 has the inlets 54 of the nozzles 35 facing the cylindrical surface 20. The flow directing passage 52 is positioned to align with the inlets 54 of the nozzles 35 as the nozzle ring 100 is turned.

Figure 3:
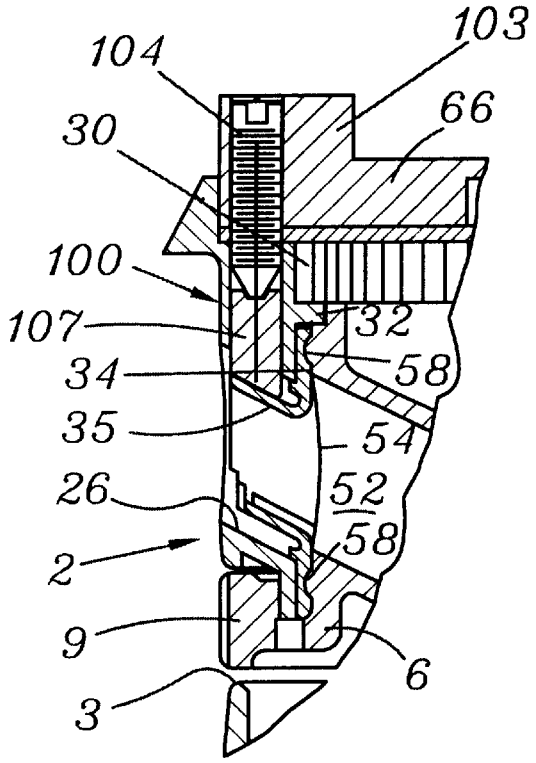
FIG. 3 is a fragmentary view in section of a portion of FIG. 1 showing a modified seal for sealing between the flexible nozzle strip and cylindrical nozzle housing and also showing a nozzle deflection camming insert operated by a nozzle range control screw.

There is a need to seal between the exit of the flow directing passage 52 and the mating surface of the flexible nozzle strip 34. An "O"-ring seal 56 surrounding the flow directing passage 52 is shown for this purpose; however, other sealing configurations can be used such as an integral raised ring 58 in place of the "O"-ring seal 56 around the exit of the flow directing passage 52 which will provide a seal when squeezed against the flexible nozzle strip 34 (see FIG. 3).

The nozzle ring 100 and the inner housing structure 6 have a cooperating mechanism therebetween for releasably holding the inlet 54 of a nozzle 35 in an aligned position with the exit of the flow directing passage 52, or at least allowing the operator during nozzle selection to feel the correct detented positions when each nozzle is placed in the correct rotational selection position. The nozzle 35 is held properly aligned until force is applied to move the nozzle ring 100 to another nozzle setting, or position.

Figure 4:
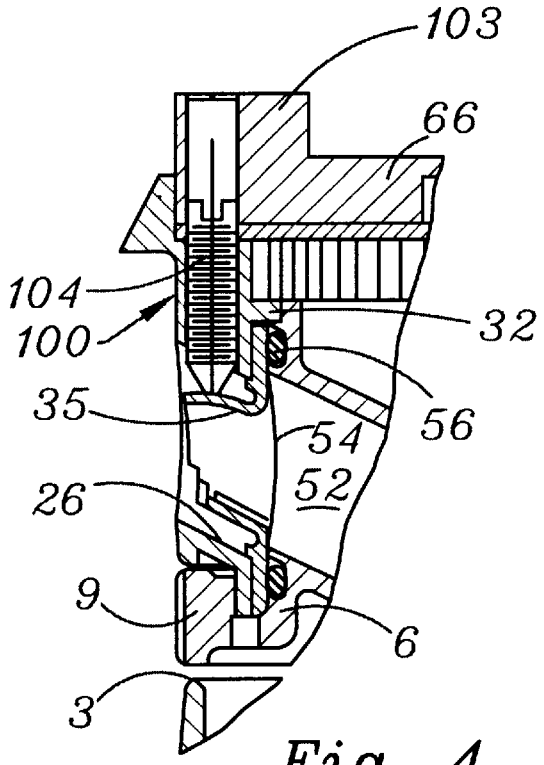
FIG. 4 is a fragmentary view in section of a portion of FIG. 1 showing the stream deflector screw turned down to engage a nozzle of said flexible nozzle strip.
Figure 5:
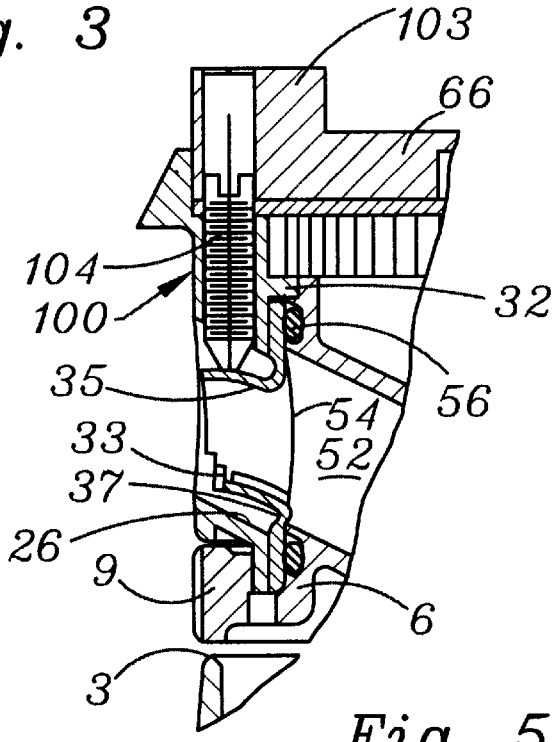
FIG. 5 is a fragmentary view in section of a portion of FIG. 1 showing a different nozzle configuration engaged by the stream deflector screw to allow deflecting the entire nozzle downwardly.

The cooperating mechanism comprises a projection 120 on a flexible arm 121 at the top of a straight section of cylindrical wall 22 of inner housing structure 6, extending away from surface 20 and aligned with indexed notches 122 that are circumferentially placed around flange 32 of nozzle ring 100 to engage the flexibly mounted projection 120 for rotational indexing. Details of the flexible arm 121 and notch 122 associated with flange 32 are not shown in FIGS. 3, 4 and 5, and could be positioned somewhere else around the circumference of flange 22 of inner housing 6, if desired. Gear tooth 30A in the area of the notches in flange 32 is shown as a shortened tooth 30B, and could also be used as a detent notch acting in conjunction with a widened projection 122 on flexible arm 121.

The inner housing structure 6 has a plate 62 across the top thereof. The top plate 62 is positioned in a recess 64 around the top of the nozzle ring 100 and rests on the nozzle ring 100 while fixed in the inner housing structure 6. A rubber cover 66 is mounted against the top plate 62. The top plate 62 provides rigidity for the rubber cover 66. The rubber cover 66 and the top plate 62 are fixed to each other and the top plate 62 is fixed to the inner housing structure 6.

The rubber cover 66 and the top plate 62 are fixed together by rubber holding plugs (not shown) in the rubber cover 66 fitting into holes in the top plate (not shown); other holding devices can be used. The top plate 62 is fixed to inner housing structure 6 by plastic plugs (not shown) extending from the top plate 62 into matching openings 68 in inner housing structure 6. One such opening 68 is shown in FIG. 2. Other holding devices can be used.

The cylindrical wall 22 extends upwardly to the flange 32. The nozzle positioning drive gear 42 has a cylindrical extension 70 on its top which extends through a matching opening 72 in the top plate 62. The extension 70 has a recess 74 to receive a key, or flat screwdriver, for applying a force to turn the nozzle ring 100. The rubber cover 66 has an opening 76 therein to fit over the cylindrical extension 70 so that the key, or screwdriver, (or other tool) can be inserted through the rubber cover 66 to enter the recess 74. The rubber cover 66 has a thin cover 78 with a slit therein over the opening 76 to keep dirt out of the recess 74.

The inner housing structure 6 has a cylindrical member 79 extending upwardly from the flow chamber 50. The cylindrical member 79 has a smaller cylindrical opening 77 in the upper part and a larger aligned cylindrical opening 80 in the lower part. The cylindrical member 79 extends through an opening 71 in the top plate 62 into a large opening 63 in the rubber cover 66. The cylindrical member 79 has a small cylindrical extension 81 at the top thereof having a smaller diameter. The small cylindrical extension 81 extends into the rubber cover 66 to support the rubber cover 66.

The arc set indicating and setting mechanism shown in FIG. 2 includes an arc set indicating cylinder member 83 having an upper smaller section 85 with a rotating fit in smaller cylindrical opening 77 in cylindrical member 79. The arc set indicating cylinder member 83 has a lower larger section 88 with a rotating fit in larger cylindrical opening 80. The "O"-ring 91 is positioned between the arc set indicating cylinder member 83 and the interior of the cylindrical member 79 of the inner housing structure 6. This location of the "O"-ring 91 is where the larger and smaller openings of cylindrical member 79 meet and the larger and smaller sections of the arc set indicating cylinder member 83 meet.

The arc set indicating cylinder member 83 extends through an opening in the rubber cover 66 and has a recess 92 in the top thereof to receive a key (or flat screwdriver) for turning it. The recess 92 has an arrowhead 94 formed at one end to point to numbers around the arc set indicating cylinder member 83 to indicate the arc of oscillation which has been set or the change of oscillation being set. The arc set indicating cylinder member 83 has an elongated slot 96 at the bottom thereof to receive a mating flattened end 98 of an angular positioning shaft 69. The angular positioning shaft 69 extends into the hollow output drive shaft 5 of the riser assembly 4. These shafts, hollow output drive shaft 5, and angular positioning shaft 69, are connected to a mechanism to control the arc of oscillation set.

Such an arc set control mechanism is shown in U.S. Pat. No. 4,901,924, issued Feb. 20, 1990 and U.S. Pat. No. 5,417,370, issued May 3, 1995, and these patents are incorporated herein by reference as though fully set forth. Other arc set arrangements in a nozzle housing are shown in referenced patent applications Ser. Nos. 09/104,456 and 09/128,130. An arrangement is also shown in U.S. Pat. No. 4,624,412; here the arc control contacts are in the nozzle housing.

The rubber cover 66 has a raised arrowhead 103 for holding a stream deflector screw 104 which can be rotated from the top through slits in the arrowhead 103 above the stream deflector screw 104. The stream deflector screw 104 extends into a groove 106 around the top of the nozzle ring 100. The stream deflector screw 104 can be moved down to effect a change in the stream of nozzle 35 or can be used to move a camming insert 107 (see FIG. 3) down against the nozzle to bend the nozzle downwardly (see FIG. 5) or flatten the top to the nozzle restricting the flow and reducing stream angle and range (see FIG. 4).

When the nozzle ring 100 is to be rotated to change to another nozzle, the stream deflector screw 104 need not be screwed upwardly as the camming insert 107 has round upwardly extending sides which will push the newly selected nozzle downwardly allowing the nozzle change without requiring the screw 104 to be backed out of the groove 106. This permits the nozzle ring 100 to be turned without having to also adjust screw 104. When the new nozzle 35 has been put in place, the stream deflector screw 104 can be screwed down to affect the output of the new nozzle 35, if desired.

Figure 6:
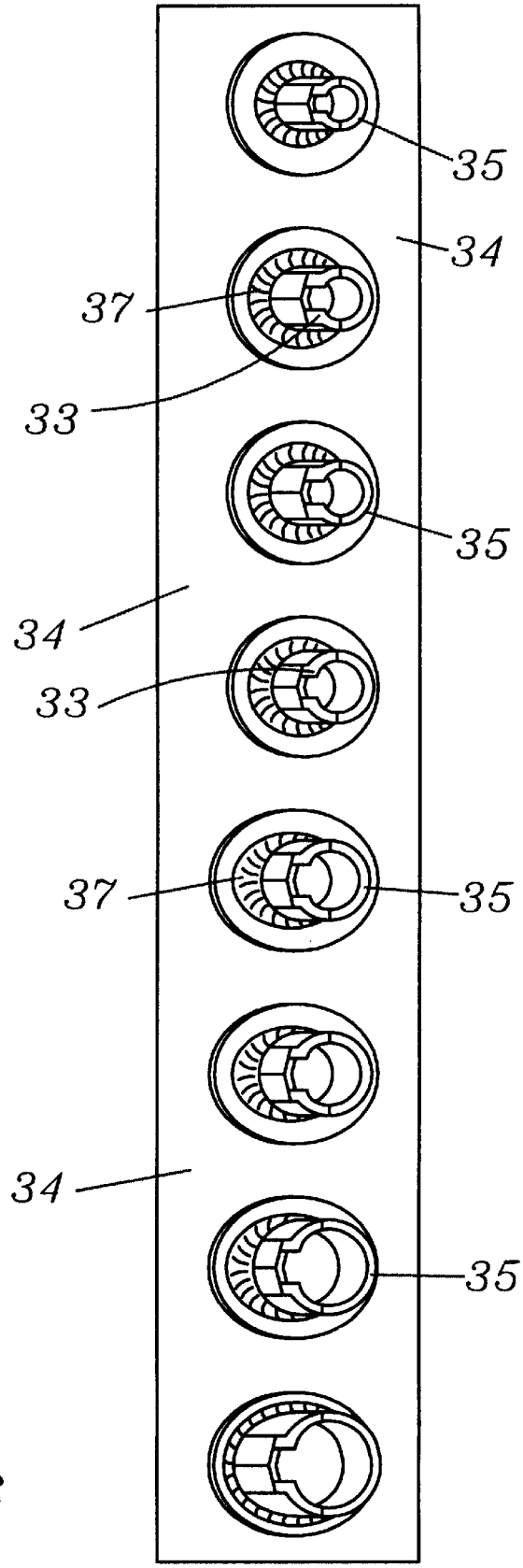
FIG. 6 is a view showing a nozzle strip used in FIG. 1 which is molded of flexible material having a plurality of nozzles.
Figure 7:
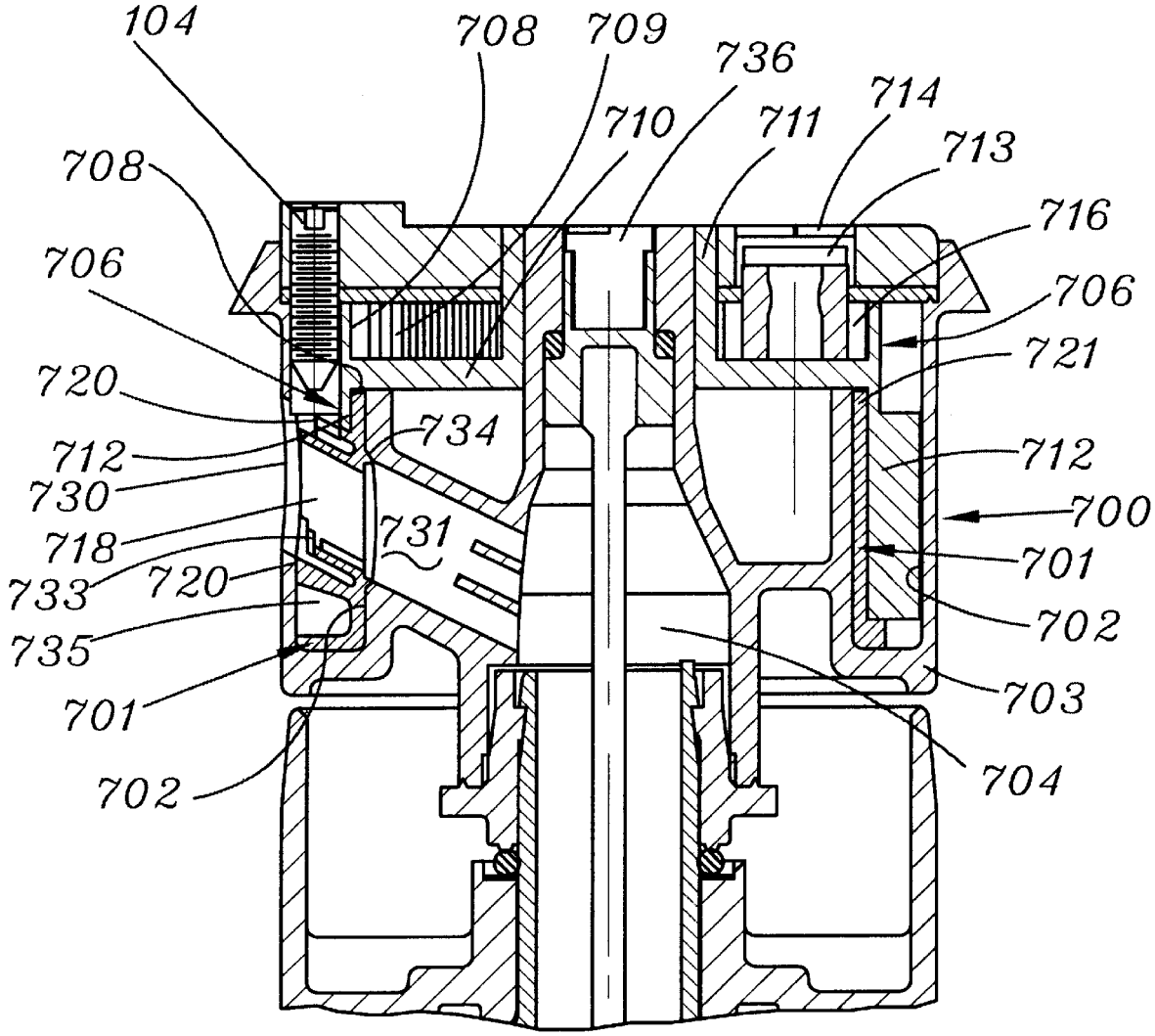
FIG. 7 shows a side view in section of the upper part of a rotary drive sprinkler having a cylindrical nozzle housing assembly with a nozzle ring taken along the line 7—7 of FIG. 8 showing an alternate configuration for the nozzle ring.

FIG. 6 shows the flexible nozzle strip 34 in its laid out, flat as molded configuration, with the nozzles protruding upwardly with their own desired shapes and angles. The back side of the strip has the desired nozzle shape for the upstream side including convergent slopes to the throat and any sharp edges, or flats, as desired to provide the desired nozzle performance, such as a sharp trip edge 33 as shown in FIG. 6. If desired, as seen in FIG. 7, a ridge 734 can be molded around each nozzle inlet opening to provide a squeeze-sealing fit to the nozzle housing flow passage 731. The strip 34 is flexible and can be bent into a circle to provide nozzles around the circumference of a nozzle housing. There can be a diaphragm area 37 around the nozzle to allow the entire nozzle to be deflected to change the exit stream angle from the nozzle housing if desired (see FIG. 5).

FIG. 7 shows the side sectional view of the upper part of a rotary drive sprinkler housing assembly 700 where a flexible nozzle strip 701 is rotated in a cylindrical cavity 702 around the outer portion of a nozzle housing 703. The nozzle strip 701 is shown flat as molded in FIG. 9. The nozzle housing 703 has a center opening 704 which is connected to the hollow drive shaft 5 to supply high pressure water to the nozzle housing assembly 700 as explained for FIG. 1, and provides the rotational drive motion to the nozzle and nozzle housing 703 causing the stream fallout pattern from the selected nozzle to cover an area as controlled by the arc of oscillation set and the effect of the breakup or stream elevation screw 104.

The nozzle strip 701 is rotated in its cylindrical cavity 702 by a cylindrical ring 706 which has an inner cylindrical surface 708 with an integral gear 709 formed at the top and with an inwardly extending annular flange 710 with an inner cylinder 711 extending upwardly to the top of the nozzle housing 703 to provide an indication of which nozzle has been selected (see FIG. 8) and/or the nozzle characteristics for the nozzle that has been selected such as flow rate at a particular pressure.

Cylindrical ring 706 also has downwardly extending fingers 712 spaced in between nozzles 718 for rotationally moving the nozzle strip 701 when nozzle selection shaft 713, which is accessible through rubber flaps 714 in the nozzle housing top, is turned. Nozzle selection shaft 713 has gear teeth 716 that engage the teeth of integral gear 709 of the cylindrical ring 706.

Figure 9:
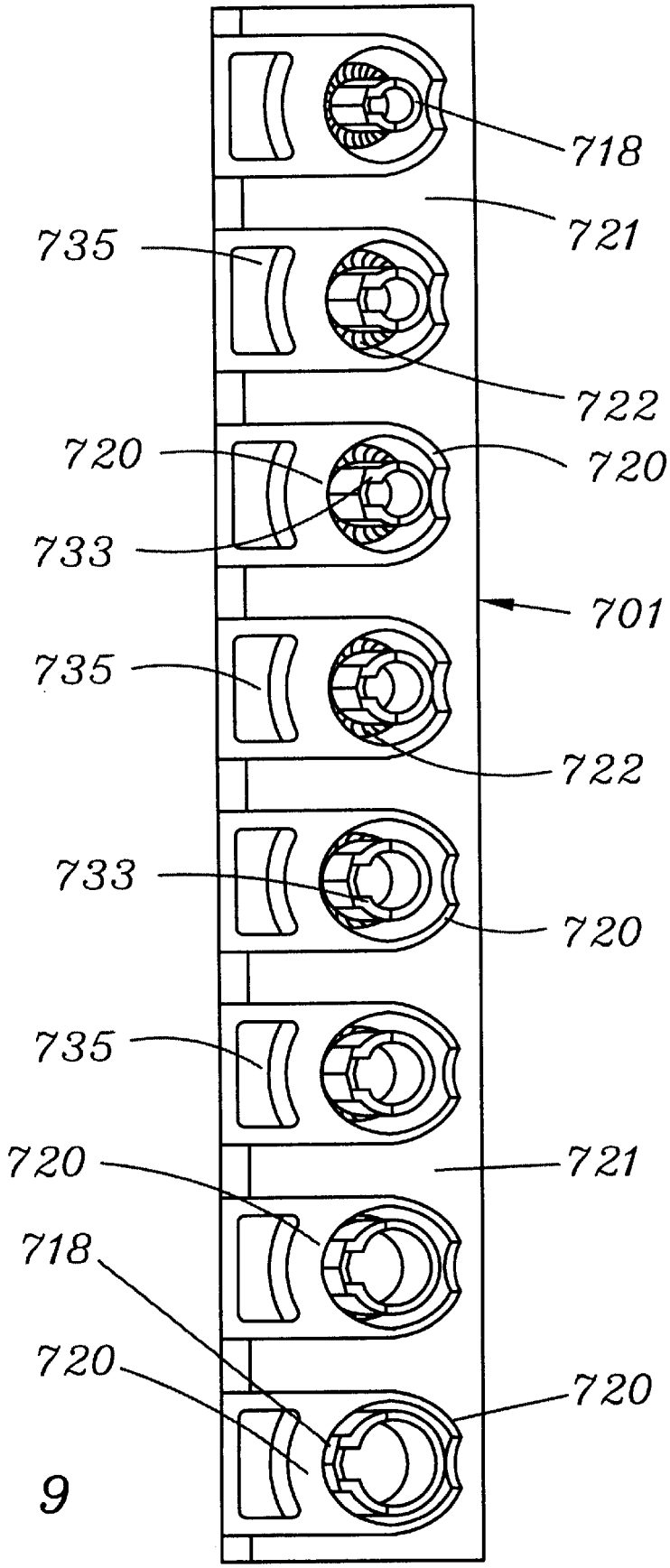
FIG. 9 is a view showing a flexible nozzle strip used in FIG. 7.
Figure 10:
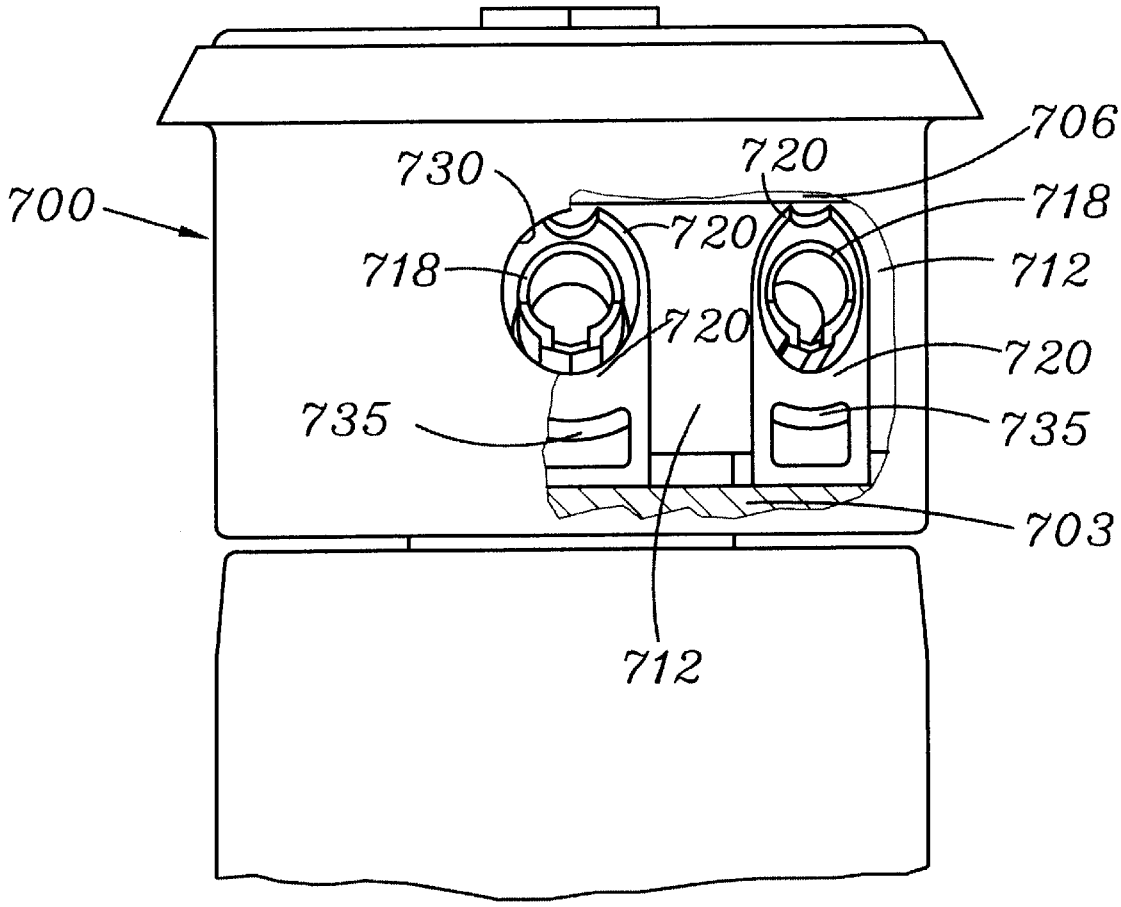
FIG. 10 is a side view of the exterior of the upper part of a rotary drive sprinkler as shown in FIG. 7 with a portion of the cylindrical nozzle housing broken away showing the position of a nozzle on the nozzle strip with the nozzle outlet opening.

The flexible nozzle strip 701 is shown in FIG. 9 with its different nozzles 718, surrounded by seal backup area 720 around the thinner nozzle connecting strip areas 721 and thinner diaphragm areas 722 around some or all of the nozzles 718 to allow the nozzles to be deflected to change stream angle using screw 104, if desired. Material can be removed from the outer surface of the nozzle strip 701 below each nozzle to save the material and speed up the molding process.

The nozzle strip 701 is rotated around its circumference in the cylindrical cavity 702 to select the desired nozzle by placing it in alignment with the single opening 730 in the exterior of the nozzle housing 703 and in sealing connection with a water supply passage 731 in the nozzle housing 703.

Arc set shaft 736 in the center is connected to an arc control contact member which can be rotationally set and indicated on the top of the sprinkler, as described in referenced U.S. Pat. No. 4,901,924 and others. This configuration provides a relatively large number of nozzles for the available nozzle housing diameter. It also opens the center of the nozzle housing 703 for a variety of arc setting configurations such as in U.S. Pat. No. 4,624,412, where the arc control contact member may be inside the nozzle housing assembly as well as being in the lower part of the sprinkler body.

Figure 11:
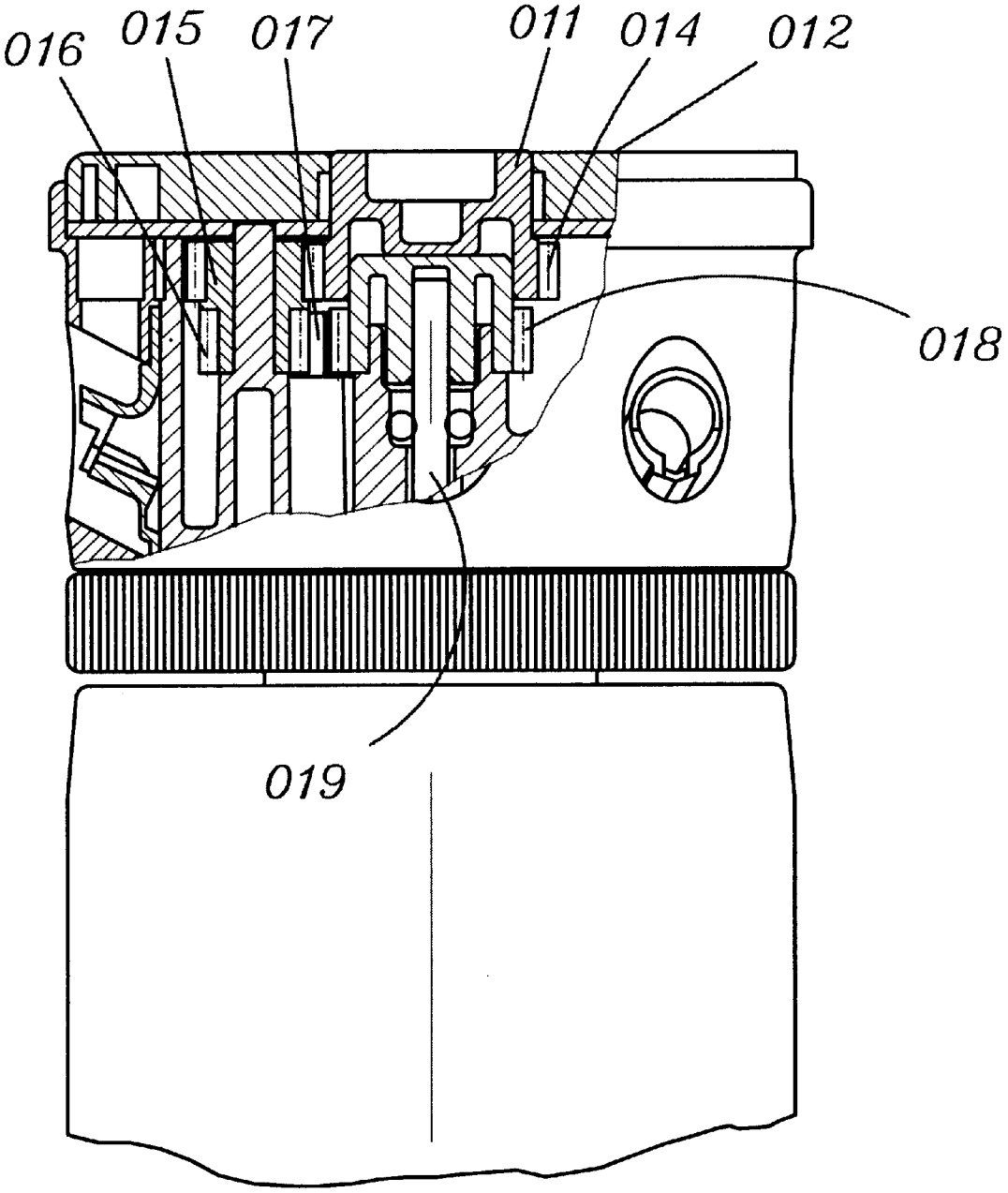
FIG. 11 is a side view partially in section of the nozzle housing showing an alternate configuration with a reversing gear connection in the arc set mechanism.

FIG. 11 shows another form of arc set where the arc set shaft is connected to a combination of gears (2 or more) to achieve a reversal action so that the arc control contact member, for example, is rotated counter-clockwise when the arc set shaft in the top of the sprinkler is rotated clockwise. This is desirable from a user logic standpoint since you are then turning the arc set shaft in the same direction as you desired the increased rotation of the nozzle. Also, if the relationship between the arc set shaft, or at least its position indicator, is made a 1:1 relationship to that of how the arc control contact member is moved, it can be made to point to the rotational position you want the nozzle to rotate to after being set. The mechanics of the reversing mechanism's interaction with the arc control contact member is described in detail in referenced U.S. Pat. No. 4,901,924 which has been incorporated into this patent application as if fully disclosed. The details of how this is achieved in the nozzle assembly are disclosed in FIGS. 11 and 12 as follows.

Figure 12:
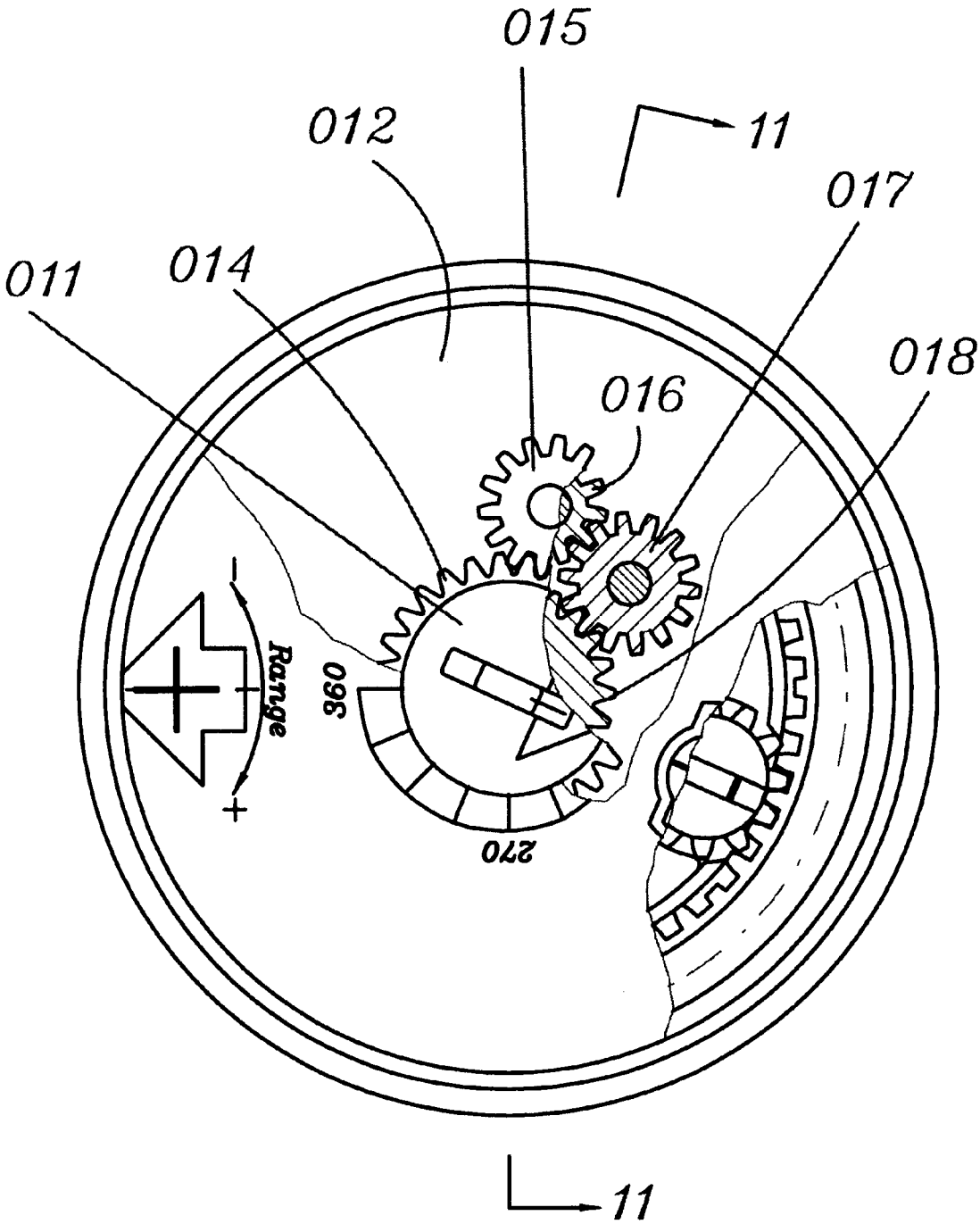
FIG. 12 is a top view of the rotary drive sprinkler of FIG. 11 showing the connecting reversing gearing for the arc set as well as an arc set and indicating shaft; also shown is a shaft for moving the nozzle ring to select and indicate the selected nozzle.

An arc set and indicating shaft 011 protrudes through the rubber cover 012 in order to allow visual observation of the arc set and indicating shaft 011 which can be used to indicate the arc that is being set in terms of just rotational physical displacement or as read on a calibrated scale on the nozzle housing top as shown in FIG. 12.

The lower portion of arc set and indicating shaft 011 has a gear 014 around its lower end which engages a second gear 015 at the top of a separate shaft which also has a gear 016 at its lower end. The lower gear 016 of the separate shaft is connected to a reversing action idler gear 017 as shown in FIG. 11 and FIG. 12 which then contacts gear 018 that is connected to the arc set shaft 019. Shaft 019 functions as arc set shaft 69 in FIG. 1, except that the arc setting and indicating shaft on the top of the nozzle housing now is turned and indicates an arc setting in the same direction as a resulting nozzle action will occur. This can also be done with a 1:1 gear ratio sizing for an internal ring gear and connecting shaft to the arc set shaft instead of the third idler gear (this configuration not shown).

Having the multiple nozzles arranged around the outside circumference of the nozzle housing allows more room for more nozzles and also more space for more complex arc setting arrangements to be in the nozzle housing.

Figure 13:
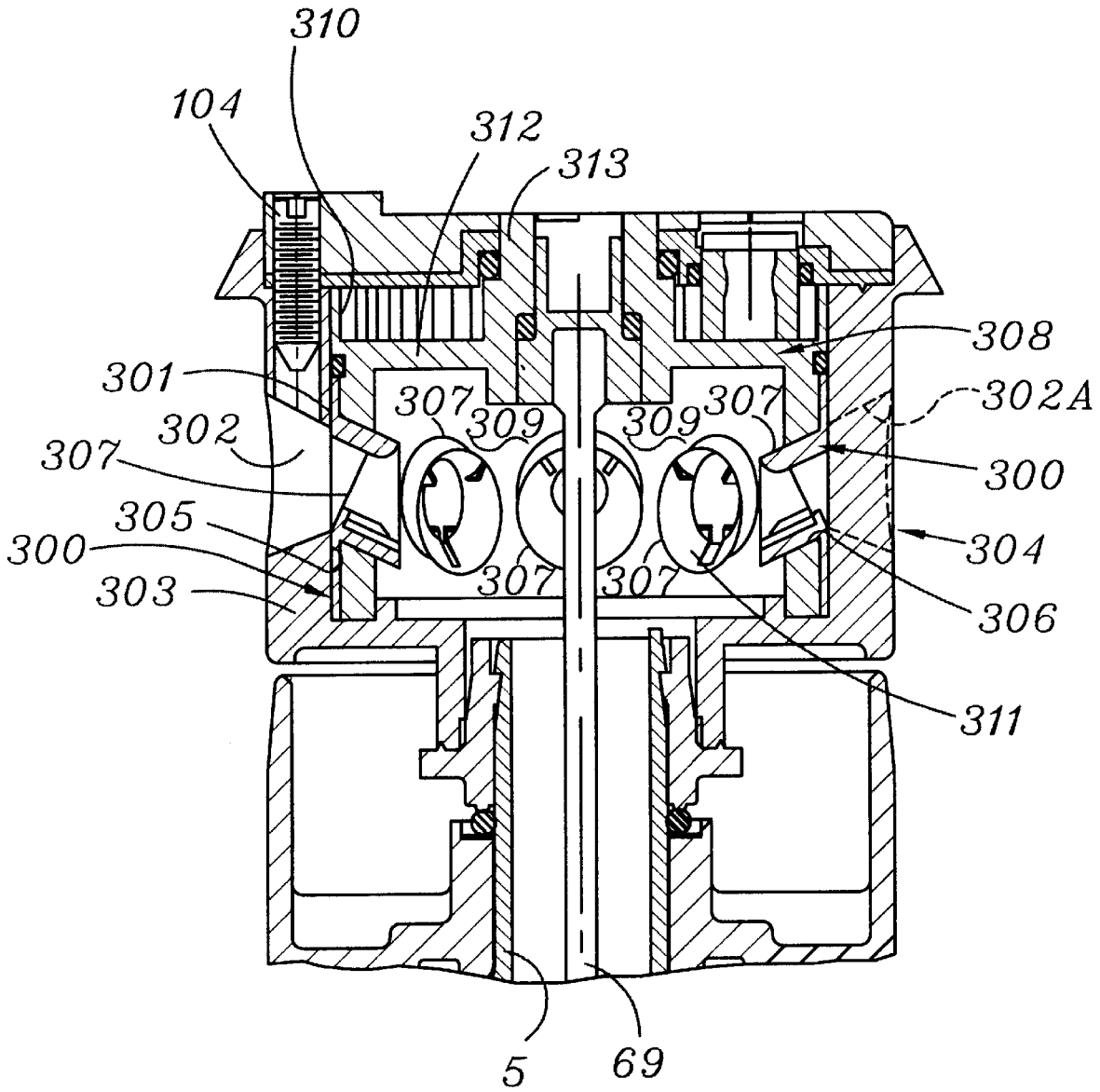
FIG. 13 is a side view in section of the upper part of a rotary drive sprinkler nozzle housing assembly with a multiple selectable nozzle strip where the nozzles are in the flow cavity of the nozzle housing.

In the selectable nozzle configuration shown in FIG. 13, the flexible nozzle strip 300 is configured with the flat seal area surface 301 of the strip 300 around the outside circumference, now at the nozzle exit end of each of the nozzles on the flexible nozzle strip and configured to seal around opening 302 on inside surface 305 in the outside wall 303 of the nozzle housing assembly 304. The advantage of this configuration is that the selected nozzle 307 is sealed to the outside by the pressure force from within the nozzle housing around a minimum diameter opening since the opening does not have to have been large enough for the seal around the large converging inlet end of the nozzle 307. The nozzle passages of the nozzles 307 may be long with a large convergence section 311 as they are positioned in a large flow cavity area 309 of the nozzle housing. The nozzle strip 300 is rolled up and placed with its nozzles 307 each in a hole 306 in rotatable cylinder 308 which is then placed into the nozzle housing 304 to form cavity 309 for receiving water from the hollow drive shaft 5.

Figure 8:
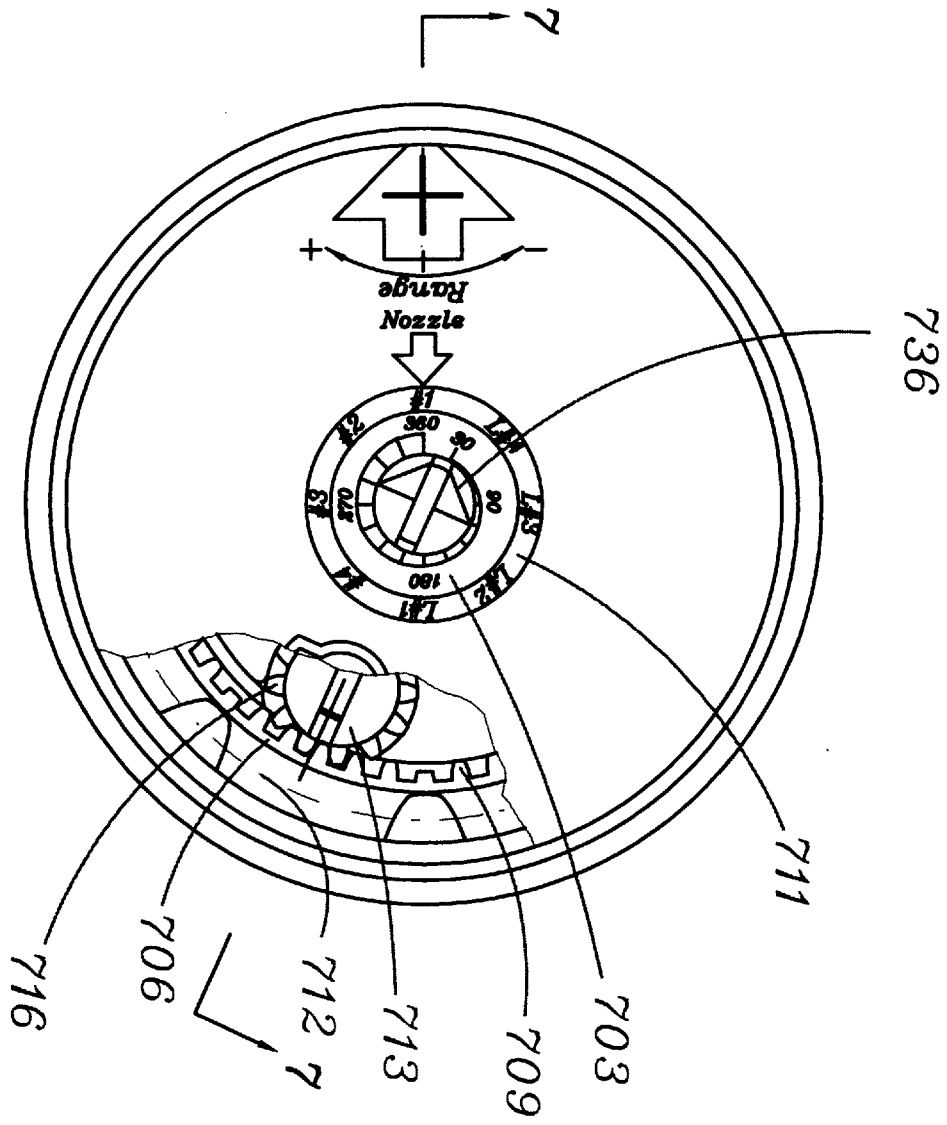
FIG. 8 is a top view of the rotary drive sprinkler of FIG. 7 showing the arc set indicator and nozzle set shaft and nozzle selected indicator.

The rotatable cylinder 308 has an inner cylindrical surface with an integral gear 310 formed at the top and with an inwardly extending flange 312 and inner cylindrical member 313 extending upwardly to the top of the sprinkler nozzle housing for indicating which nozzle has been selected and the other nozzles available to be selected (see FIG. 8).

In FIG. 13, the stream breakup screw 104 remains in place and can be screwed down into the stream to shorten the range or increase the near field stream water fallout for which ever nozzle is rotated into sealing alignment with outlet opening 302 of wall 303 of nozzle housing 304.

Figure 14:
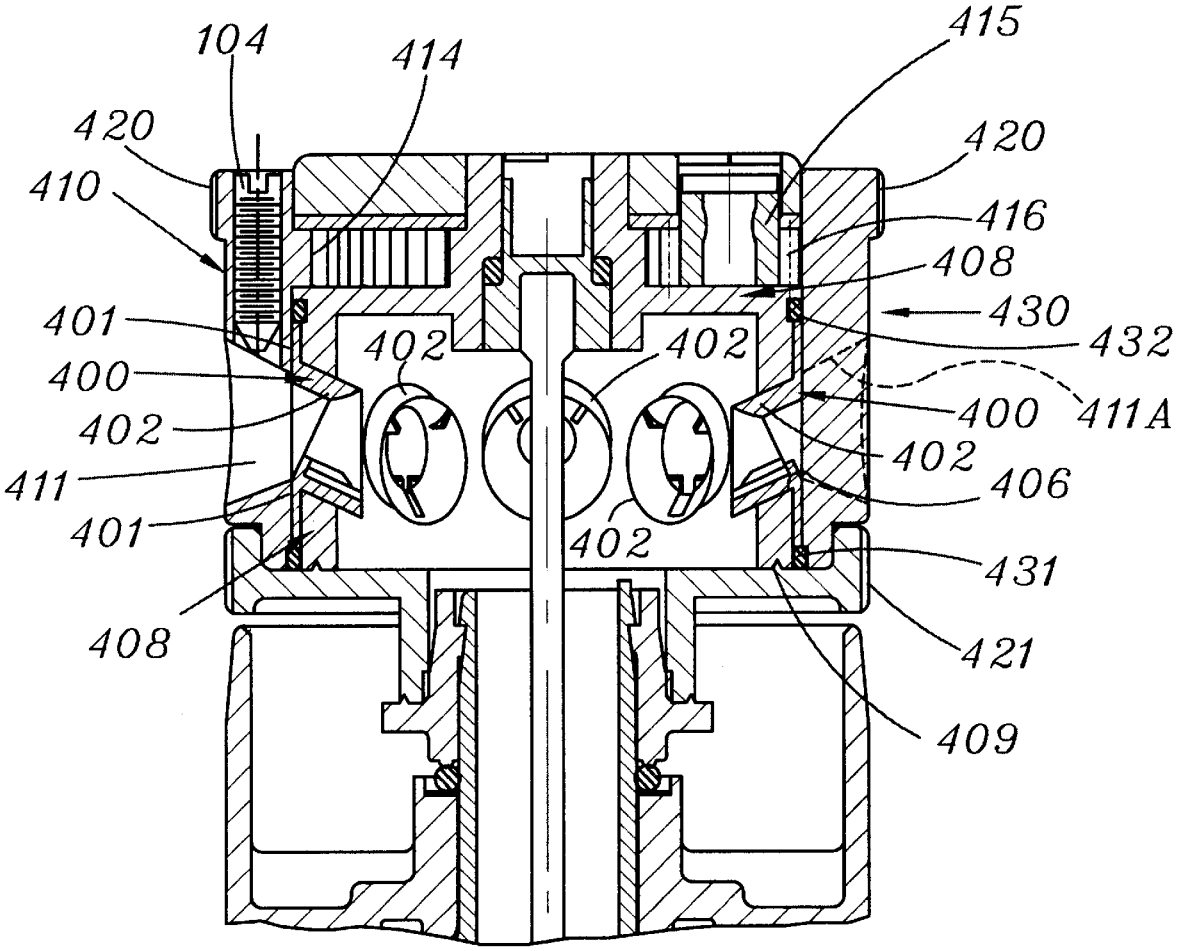
FIG. 14 is a side view in section of the upper nozzle housing of a rotary drive sprinkler housing assembly where the multiple selectable nozzle strip is fixed in the flow area of the nozzle housing and the exit opening of the nozzle housing is rotated to select the desired nozzle.

In FIG. 14, the flexible nozzle strip 400 has a seal area 401 around the exit end of its nozzles 402. However, in this configuration, (see FIG. 14), the stationary cylindrical member 408 with the holes 406 around its circumference into which the nozzles 402 are placed, is rotationally fixed and sealed to the nozzle housing by sonic welding or other means at 409.

As can now be seen in FIG. 14, the cylindrical ring 410 is placed over the outside of nozzle strip 400. Ring 410 has at least one opening 411 which can be rotationally aligned with the desired nozzle, or nozzles, 402 by an internal gear 414 at its top and the interacting gear 416 on nozzle selection shaft 415.

When nozzle selection shaft 415 is rotated, its interacting gear 416, mating with gear 414 of outer cylindrical housing ring 410, causes the nozzle selection opening 411 in the ring 410 to be rotationally moved around the outside circumference of the flexible nozzle strip 400 to indicate which nozzle has been selected. Circumferential seals can be provided between the stationary cylindrical member 408 and the rotatable cylindrical member 410 at the top and bottom as required to seal the water pressure in the nozzle housing.

Figure 15:
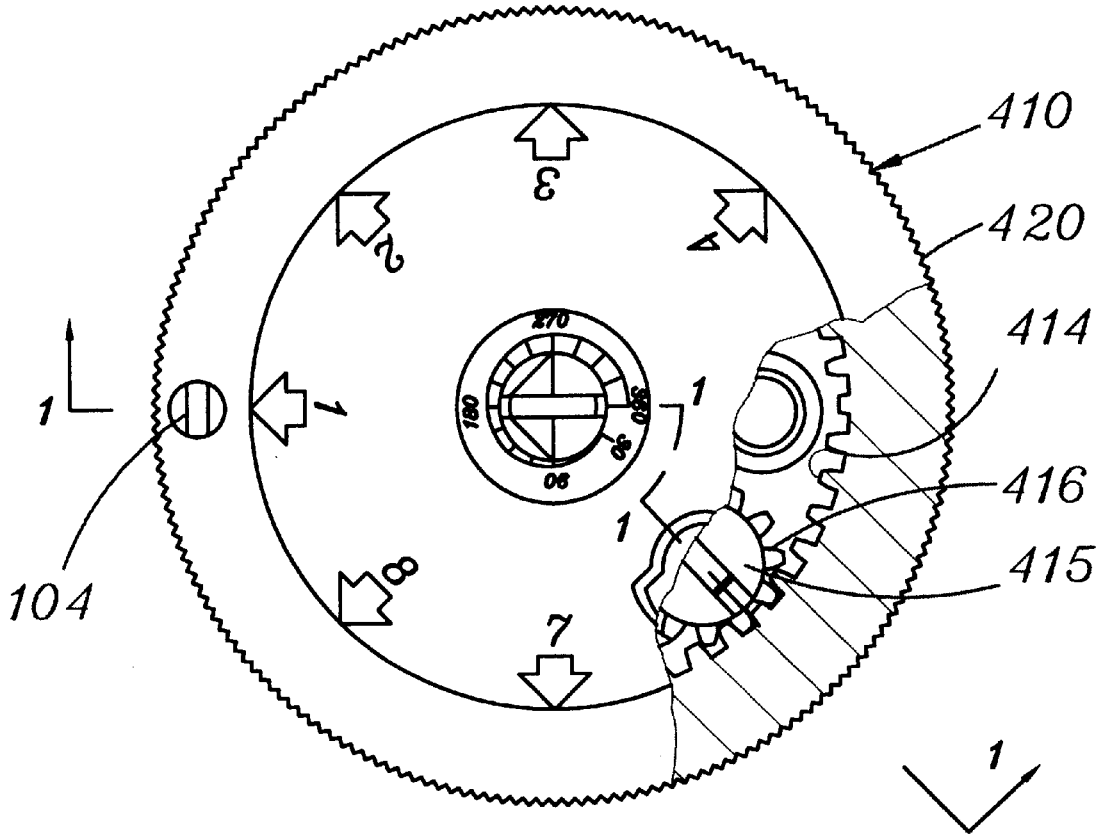
FIG. 15 is a top view of the rotary drive sprinkler of FIG. 14 showing the arc set and nozzle setting shafts and the arc and nozzle selected indications.

As seen in FIG. 14 and 15, which is the top view of this nozzle configuration, the nozzle selection ring 410 has serrations 420 around its upper outside circumference so that it could be rotated by gripping these and holding the other portions of the nozzle housing serrations 421. "O"-ring seals 431 and 432 have been added above and below the flexible nozzle strip 400 to assure a water-tight seal between stationary housing 408 and rotatable selection ring 410.

The nozzle stream breakup screw head 104, or other indices, can be used to show the rotational position of the exit opening in the nozzle selection ring 410 as shown in FIG. 15. There is a single stream control screw 104 positioned to be screwed into the selected nozzle exit stream.

Having more than one exit opening 411, such as shown by dashed lines 411A in FIG. 14, in the outer rotatable selection ring 410 allows, for example, selecting one nozzle optimized for long range on one side and a matched nozzle 180° away with a second exit opening 411A that is optimized for a close-in fallout pattern. This arrangement could provide optimum performance for sprinklers that are adjusted to run 360° rotation. Another option, for example, would be to have two long range full fallout pattern nozzles 180° apart and two short range full fallout pattern nozzles 180° apart with 90° displacement between the long and short range nozzles to provide a strip pattern sprinkler if it were adjusted to oscillate through a small arc, i.e., 30°.

Figure 16:
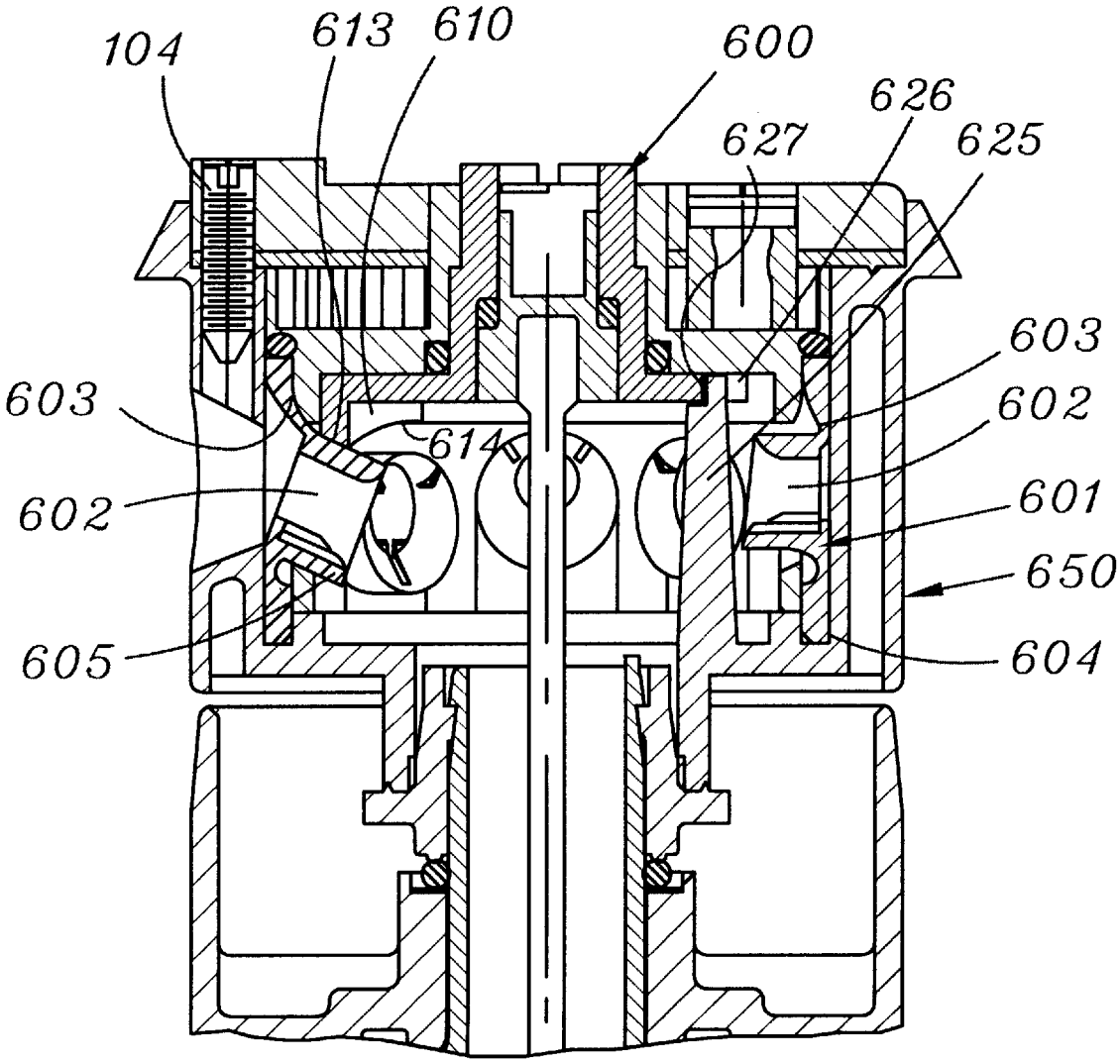
FIG. 16 is a side view in section of a rotary drive sprinkler nozzle housing where the nozzle strip of multiple nozzles is rotatable in a flow area of the nozzle housing and includes being settable at different flow angles from the top by a nozzle angle deflection camming member.
Figure 17:
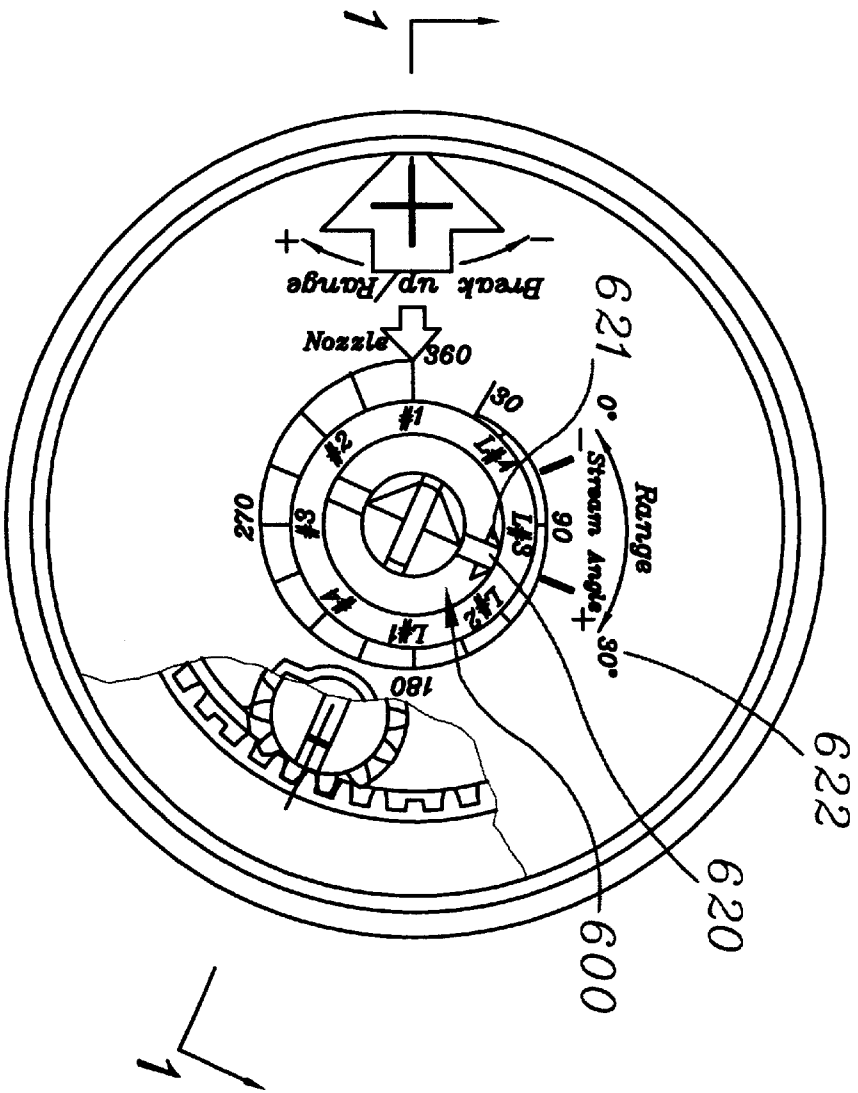
FIG. 17 is a top view of the sprinkler nozzle housing of FIG. 16 showing the arc set, the nozzle selected, the nozzle stream angle setting, and the stream breakup screw.

As shown in FIGS. 16 and 17, which is an additional feature disclosure of FIG. 13, an additional stream angle control shaft 600 has been added and the flexible nozzle strip 601 with nozzles 602 are provided with a diaphragm area 603 around the nozzle to allow the axis of a nozzle 602 to be bent relative to the nozzle strip flat surface 604. Each nozzle 602 has a tube shape 605 extending inwardly.

In the FIG. 16 configuration, a camming portion 610 that is attached to the stream angle control shaft 600, is configured so as to press downwardly on the nozzle tube shape 605 at 613 to deflect the nozzle tube inlet end downwardly causing the stream angle to be elevated as the stream angle control shaft 600 is rotated clockwise and the camming surface 614 of the camming portion 610 increases progressively downwardly against the nozzle tube 605. If the control shaft 600 is moved in a counter-clockwise direction, the camming surface 614 moves away from the nozzle tube 605 and internal pressure against the thinner diaphragm surface 603 around the nozzle 602 causes the nozzle to be rocked toward the outside lower pressure and lowers the stream angle.

FIG. 17 shows the slot 620 for turning the stream angle control shaft 600 and indicating the stream angle by arrows 621 and indices 622. Arc setting and selected nozzle are also shown. This configuration also allows the stream breakup screw 104 to function separately from the stream exit angle for better control of range and the stream fallout pattern.

A rib 625, which is fixed to the nozzle housing 650, has a rotational stop action between the nozzle housing 650 and the stream angle control 600. An arcuate slot 626 in the stream angle control 600 has the rib 625 positioned in the arcuate slot 626 to limit the rotation of stream angle control 600 to maintain it over the nozzle tube of the nozzle that has been selected. A notch 627 of the rib 625 can be used to hold the stream angle control 600 vertically in place and generate friction if interacting serrations are added between the rib 625 and stream angle control 600 at the inside surface of the arcuate slot 626.

More than one exit opening can be placed in the outer wall of FIGS. 7, 13, and 16 to achieve the type of selected flow as discussed for FIG. 14. Such a secondary exit opening is also shown by dotted lines 302A in FIG. 13.

While the principles of the invention have now been made clear in illustrative embodiments, it will become obvious to those skilled in the art that many modifications in arrangement are possible without departing from those principles. The appended claims are, therefore, intended to cover and embrace any such modifications, within the limits of the true spirit and scope of the invention.

What is claimed is:

1. A rotary drive sprinkler comprising:

a nozzle assembly having an inner circumferential slot; and a flexible nozzle strip having selectable nozzles along the length thereof, said flexible nozzle strip being positioned within said inner circumferential slot of said nozzle assembly, each of said nozzles being individually selectable for directing water therefrom.

2. A rotary drive sprinkler as set forth in claim 1, wherein said nozzle assembly has a water supply passage, and said flexible nozzle strip is rotatable in said slot to align a desired nozzle with said water supply passage in said nozzle assembly.

3. A rotary drive sprinkler as set forth in claim 1, wherein said nozzle assembly has an outer nozzle housing, said outer nozzle housing have at least one stream exit opening, said flexible nozzle strip being rotatable to align a desired nozzle with a stream exit opening.

4. A rotary driver sprinkler as set forth in claim 1, wherein said nozzle assembly includes a detent arm for generating a tactile indicator to aid in nozzle selection and/or holding the selected nozzle in proper rotational position after selection.

5. A rotary drive sprinkler as set forth in claim 1, wherein said flexible nozzle strip can be formed of a plurality of smaller strips.

6. A rotary drive sprinkler as set forth in claim 5, wherein each of the plurality of flexible nozzle strips is colored to represent a desired flow characteristic.

7. A rotary drive sprinkler as set forth in claim 1, wherein the nozzle assembly includes a nozzle housing having a top surface, wherein the top surface of said nozzle housing provides indicators for indicating a selected nozzle and a nozzle stream angle setting.

8. A rotary drive sprinkler as set forth in claim 7, wherein the top surface of said nozzle housing also provides an indicator for indicating an arc setting of a stream delivered from the selected nozzle.

9. A rotary drive sprinkler comprising a nozzle assembly with selectable nozzles along the length of a flexible nozzle strip, said flexible nozzle strip being wrapped around an inner cylindrical surface of said nozzle assembly, each of said nozzles being individually selectable for directing water therefrom.

10. A rotary drive sprinkler for receiving a supply of water, comprising:

a nozzle housing assembly for directing water from said sprinkler, said nozzle housing assembly having an inner housing with a plurality of openings positioned substantially around the circumference of said inner housing, said openings intersecting an inner circumferential surface of said inner housing; and a nozzle strip having a plurality of nozzles along its length with each of its nozzles projecting into a respective one of said plurality of openings.

11. A rotary drive sprinkler as set forth in claim 10, wherein said nozzle housing assembly has a top thereon, said housing having a device operable from the top of said nozzle housing assembly for rotating said housing.

12. A rotary drive sprinkler as set forth in claim 11, wherein said housing has an internal ring gear, said device being a drive gear connected to said ring gear to actuate it.

13. A rotary drive sprinkler comprising:

a sprinkler housing for receiving a supply of water;

a nozzle assembly for directing water therefrom, said nozzle assembly having an outer cylindrical housing having an inner surface therearound with an opening extending to the outside circumference thereof; and a flexible nozzle strip having a plurality of nozzles fabricated thereon, said flexible nozzle strip being rotatably mounted to said nozzle assembly such that said nozzles are substantially arranged into a circle of circumferentially spaced nozzles, wherein said nozzle strip can be rotationally moved from the outside of the nozzle housing for aligning a desired nozzle with the opening in said outer cylindrical housing.

14. A rotary drive sprinkler as set forth in claim 13, wherein said outer cylindrical housing has a top surface on which is provided indicators for indicating a selected nozzle and a nozzle stream angle setting.

15. A rotary driver sprinkler as set forth in claim 14, wherein said nozzle assembly includes a detent arm for generating a tactile indicator to aid in nozzle selection and/or holding the selected nozzle in proper rotational position after selection.

16. A rotary drive sprinkler as set forth in claim 14, wherein the top surface of said outer cylindrical housing also provides an indicator for indicating an arc setting of a stream delivered from the selected nozzle.

* * * * *